US006750434B1

(12) United States Patent
Han et al.

(10) Patent No.: US 6,750,434 B1
(45) Date of Patent: Jun. 15, 2004

(54) MICROWAVE OVEN

(75) Inventors: Dae-Sung Han, Hwasung (KR); Yong-Woon Han, Kunpo (KR); Han-Seong Kang, Suwon (KR); Joo-Yong Yeo, Suwon (KR); Seong-Deog Jang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/324,057

(22) Filed: Dec. 20, 2002

Related U.S. Application Data

(60) Provisional application No. 60/403,440, filed on Aug. 15, 2002.

(51) Int. Cl.[7] ..... H05B 6/80

(52) U.S. Cl. ..... 219/757; 219/740; 219/756; 126/21 A; 126/190

(58) Field of Search ..... 219/756, 757, 219/739, 740, 741, 742, 681, 400; 174/35 R, 35 GC; 126/190, 198, 21 A

(56) References Cited

U.S. PATENT DOCUMENTS 3,594,531 A * 7/1971 Hough ..... 219/740
3,654,417 A * 4/1972 Javes et al. ..... 219/757
3,943,318 A * 3/1976 Hirai ..... 219/740
4,618,756 A * 10/1986 Schwaderer et al. ..... 219/757
4,645,892 A * 2/1987 Gustafsson ..... 219/742
5,365,918 A 11/1994 Smith et al. ..... 126/21 A
6,462,320 B1 * 10/2002 Fuls et al. ..... 219/700

FOREIGN PATENT DOCUMENTS

JP 1-184332 * 7/1989 ..... 219/740

OTHER PUBLICATIONS

U.S. patent application Ser. No. 10/323,739, Dae–Sang Han et al., filed Dec. 20, 2002.
U.S. patent application Ser. No. 10/323,740, Dae–Sang Han et al., filed Dec. 20, 2002.

* cited by examiner

*Primary Examiner*—Philip H. Leung
(74) *Attorney, Agent, or Firm*—Staas & Halsey LLP

(57) ABSTRACT

A microwave oven includes a cooking chamber having opening and a door which selectively opens and closes the opening of the cooking chamber. The door includes a frame which is constructed to form a circumferential edge of the door and be brought into contact with a rim of the opening, and a see-through member adapted to correspond to the opening of the cooking chamber. The see-through member is projected forward so as to allow a user to observe the interior of the cooking chamber from a variety of viewing locations or angles. Furthermore, air feed holes and air discharge holes are formed near the door so as to prevent moisture of food from condensing on the see-through member.

18 Claims, 4 Drawing Sheets

MICROWAVE OVEN

This application claims the benefit of U.S. Provisional Patent Application No. 60/403.440, filed Aug. 15, 2002 in the United States Patent and Trademark Office.

BACKGROUND OF THE INVENTION

1. Field of the Invention

The present invention relates to a microwave oven, and more particularly, to a microwave oven having a door which is constructed to be half-cylindrically projected forward, so as to allow a cooking chamber to be observed from a variety of locations exterior of the microwave oven, and allow air fed into the cooking chamber to smoothly flow along an arcuate inside surface of the door, thus preventing moisture from condensing on the inside surface of the door.

2. Description of the Related Art

Generally, a microwave oven is an appliance that cooks or heats food laid in a cooking chamber using microwaves that are generated by a magnetron disposed in a machine room. The microwave oven cooks or heats the food using a frictional heat produced between moisture molecules of the food, and generated by irradiating the microwaves into the cooking chamber. That is, the microwaves repeatedly change the molecular arrangement of moisture contained in the food to cook the food.

FIG. 1 shows a perspective view of a conventional microwave oven with its door 8 opened. As shown in FIG. 1, the microwave oven comprises a housing 1 having a machine room 2 and a cooking chamber 3 which are partitioned from each other in the interior of the housing 1. A magnetron 4 which generates microwaves, and a blower fan 5 which cools the magnetron 4 and discharges moisture and odor generated from food to the outside of the microwave oven are mounted in the machine room 2. The blower fan 5 discharges the moisture and odor by circulating air through the cooking chamber 3.

The cooking chamber 3 is constructed in a form of a box with its front opened. The cooking chamber 3 has a rectangular bottom 3*a*, a front end of which is laid on the same plane as a front of the cooking chamber 3. A turntable 6 which allows the food to be laid thereon, and a rotation guide (not shown) which rotatably supports the turntable 6 are mounted on the rectangular bottom 3*a*. The turntable 6 is rotated at a relatively low speed while being coupled to a motor (not shown) disposed under the cooking chamber 3.

The door 8 is rotatably hinged to one side of the housing 1 in front of the cooking chamber 3 so as to selectively open and close the cooking chamber 3. The door 8 is constructed in a form of a rectangle. A see-through member 9 having a plurality of see-through holes is fitted into a center portion of the door 8 to allow a user to see through the door 8. The door 8 including the see-through member 9 has planar front and back surfaces. Accordingly, where the door 8 is tightly closed, the planar back surface of the door 8 comes into close contact with the front of the cooking chamber 3, and the front of the door 8 constitutes a plane.

Where the microwave oven operates, the microwaves generated by the magnetron 4 are irradiated into the cooking chamber 3, and simultaneously, the turntable 6 is rotated at a relatively low speed. Accordingly, the food laid on the turntable 6 is cooked by the irradiated microwaves.

However, since the conventional microwave oven having the construction as described above is shaped in a form of a hexahedron and the see-through member 9 formed to allow a user to see through the door 8 constitutes a plane along with the frame of the door 8, the user has to observe the interior of the cooking chamber 3 with his eyes being level with the see-through member 9. That is, the user must adjust his/her body toward and directly in front of the see-through member 9 to ascertain a cooking status of the food.

Specifically, the door 8 of the conventional microwave oven and the see-through member 9 thereof are planar, and a region where the see-through holes are formed is small as compared to the overall size of the door 8. Therefore, the user has to approach the see-thorough member 9 to observe the interior of the cooking chamber 3. As a result, the conventional microwave oven is inconvenient and time-consuming for the user to ascertain the cooking status of the food being cooked in the cooking chamber. Therefore, the user cannot carry out other tasks and must remain attentive to the microwave oven while cooking the food with the conventional microwave oven.

Additionally, the conventional microwave oven has a planar door 8, so air fed into the cooking chamber 3 through air inlet holes (not shown) formed on one sidewall of the cooking chamber 3 is brought into collision with an inside surface of the planar door 8. Consequently, moisture generated from the food, for example, at the time of cooling, condenses on the inside surface of the planar door 8. Therefore, the user has a further difficulty in making a visual contact with the cooking chamber 3 through the planar door 8.

SUMMARY OF THE INVENTION

Accordingly, it is an aspect of the present invention to provide a microwave oven which allows a cooking status of food being cooked in a cooking chamber to be easily and rapidly ascertained from various locations outside of the microwave oven.

Another aspect of the present invention is to provide a microwave oven which effectively prevents moisture generated from food from condensing on an inside surface of a door, thus improving a see-through function of the door of the microwave oven.

Additional aspects and advantages of the invention will be set forth in part in the description which follows and, in part, will be obvious from the description, or may be learned by practice of the invention.

To achieve the above and/or other aspects of the present invention, there is provided a microwave oven comprising a heating unit to cook food, a cooking chamber having an opening, and a door which selectively opens and closes the opening of the cooking chamber. The door comprises a frame which is constructed to form an outer edge of the door and be brought into contact with a rim of the opening and a see-through member which is adapted to correspond to the opening of the cooking chamber and prevent moisture of the food from condensing thereon, wherein the see-through member is projected forward to form an inner space in front of the cooking chamber so as to provide a multiple plane of views into an interior of the cooking chamber.

The see-through member may comprise a front plate having a half-cylindrical shape projected away from the cooking chamber, and top and bottom plates having a semi-circular shape which cover a corresponding top and bottom of the inner space formed in front of the cooking chamber, wherein the front and top plates include a plurality of see-through holes which provide optical views into the interior of the cooking chamber therethrough.

The microwave oven may further comprise a transparent panel attached to the front of the see-through member to prevent the interior of the cooking chamber from communicating with the outside of the microwave oven, through the see-through holes.

The microwave oven may further comprise air feed through holes to receive air into the cooking chamber and air discharge holes to discharge the air from the cooking chamber to the outside of the microwave oven. The air feed through and air discharge holes may be provided to corresponding sidewalls of the cooking chamber at respective positions adjacent to the door so as to have the air from the air feed through holes flow along an arcuate inside surface of the see-through member and prevent the moisture from condensing on the arcuate inside surface of the see-through member.

The see-through holes may be formed across an entire area of the see-through member so as to allow an effective visual view of the interior Of the cooking chamber.

The heating unit may include a magnetron which generates microwaves to cook the food, and the frame may include a plurality of choke slits which prevent a leakage of the microwaves from the cooking chamber through the door, where the opening is closed by the door.

The frame of the door may be sized so as not to obstruct the cooking chamber and have the inner space of the see-through member form a cooking space together with the cooking chamber.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
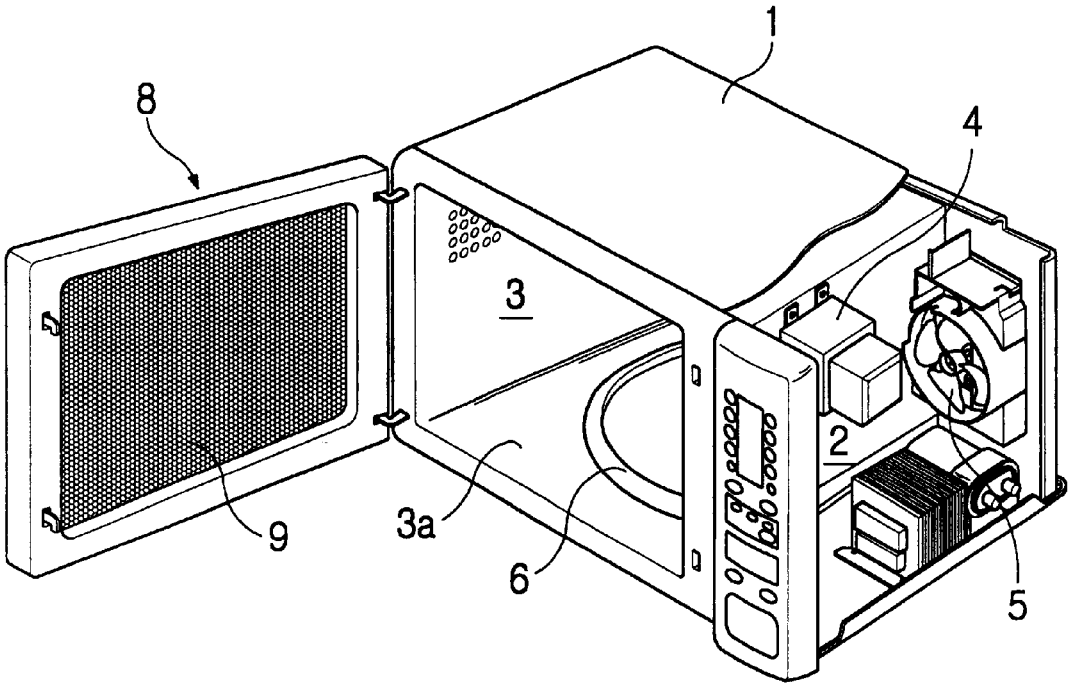
FIG. 1 (PRIOR ART)
FIG. 1 is a perspective view of a conventional microwave oven with its door being opened.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
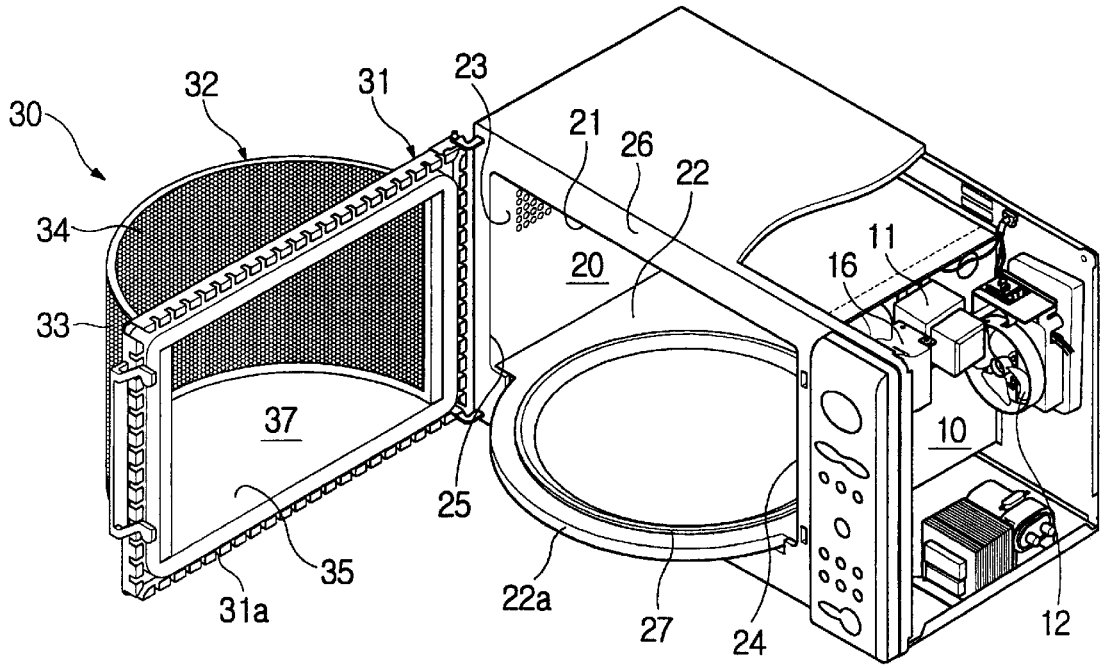
FIG. 2 is a perspective view showing a microwave oven with its door being opened according to an embodiment of the present invention.
Figure 3:
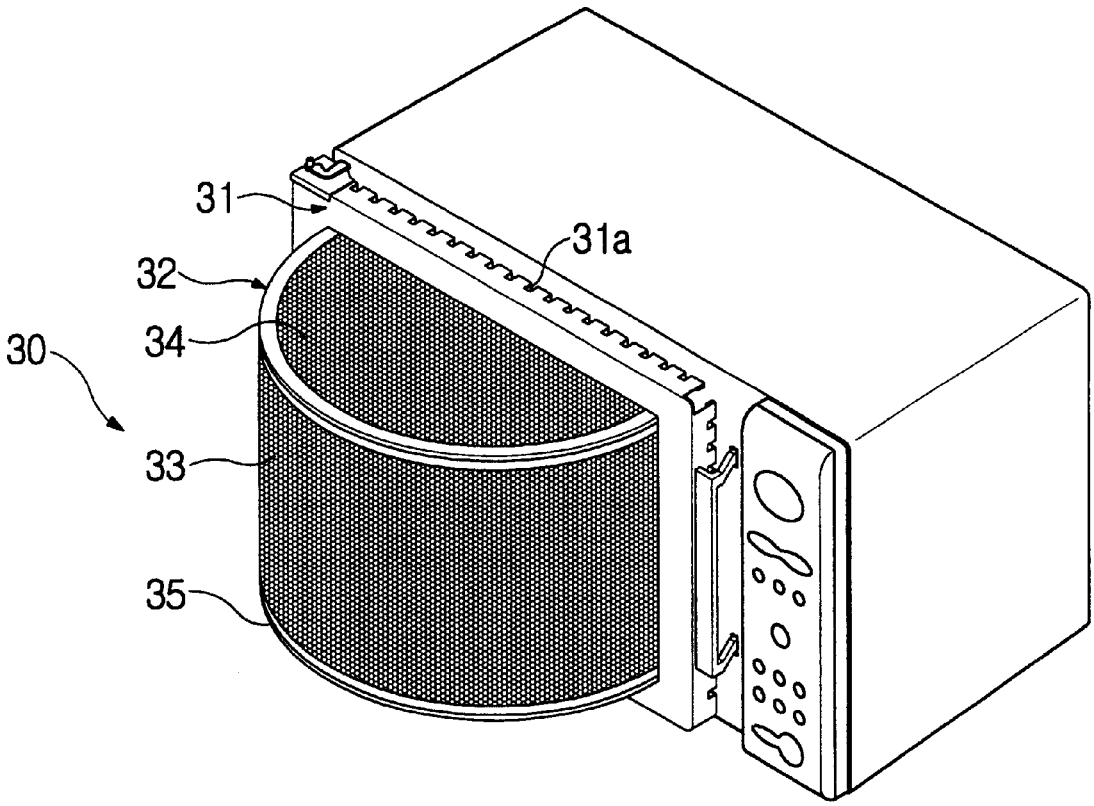
FIG. 3 is a perspective view of the microwave oven shown in FIG. 2 with its door being closed.

FIGS. 2 and 3 show perspective views of a microwave oven according to an embodiment of the present invention, wherein a door 30 is opened in FIG. 2 and closed in FIG. 3.

As shown in FIGS. 2 and 3, the microwave oven comprises a machine room 10 in which various electrical parts are mounted to generate microwaves, a cooking chamber 20 which provides a space to cook food and has an opened front, and the door 30 which selectively opens and closes the cooking chamber 20.

The machine room 10 includes a magnetron 11 which generates the microwaves, and a blower fan 12 which cools the magnetron 11 and discharges moisture and odor generated from the food to the outside of the microwave oven:.

The cooking chamber 20 is defined by a top 21, a bottom 22, sidewalls 23 and 24 and a rear wall (not shown). Additionally, the cooking chamber 20 is provided with a front opening 25 to allow the front of the cooking chamber 20 to be opened. The door 30 is rotatably hinged to the front of the cooking chamber 20 so as to selectively open and close the front opening 25. A rectangular rim 26 is formed around the front opening 25 of the cooking chamber 20 so as to tightly close the front opening 25 by coming into close contact with a frame 31 of the door 30, where the door 30 is closed.

A turntable 27 which allows food to be cooked or heated thereon, and a rotation guide (not shown) which rotatably supports the turntable 27 are mounted on the bottom 22 of the cooking chamber 20. The turntable 27 allows food to be effectively cooked by uniformly irradiating the microwaves onto the food while being rotated at a relatively low speed by a motor (not shown) disposed under the bottom 22 of the cooking chamber 20.

The door 30 includes the frame 31 and a see-through member 32. The frame 31 has a rectangular shape so as to prevent a leakage of the microwaves while being in close contact with the rectangular rim 26 that defines the front opening 25 of the cooking chamber 20. The see-through member 32 is fitted into an opening of the frame 31 and allows a user to see through the door 30 so as to ascertain a cooking status of the food in the cooking chamber 20.

A plurality of choke slits 31 a are formed along an inner edge of the frame 31. The choke slits 31 a prevent a leakage of the microwaves where the frame 31 is brought into contact with the rectangular rim 26 of the front of the cooking chamber 20.

The see-through member 32 comprises a front plate 33 which is half-cylindrically projected forward, a top plate 34 which is laid on a top of the front plate 33 to cover a top of an inner space formed inside the front plate 33, and a bottom plate 35 which is laid under a bottom of the front plate 33 to cover a bottom of the inner space.

To allow the half-cylindrically projected see-through member 32 to form a cooking space 37, which communicates with the cooking chamber 20, a front part 22*a* of the bottom 22 of the cooking chamber 20 is semi-circularly projected forward from the cooking chamber 20. Accordingly, where the door 30 closes the cooking chamber 20, the front part 22*a* of the bottom 22 of the cooking chamber 20 is positioned over the bottom plate 35 of the see-through member 32, and an interior of the half-cylindrical see-,through member 32 forms the cooking space 37.

A plurality of see-through holes are closely arranged on the front and top plates 33 and 34 of the see-through member 32 to allow a user to see through the door 30. Therefore, the user can observe the interior of the cooking chamber 20 through the front and top plates 33 and 34 of the see-through member 32. That is, with the microwave oven of the present invention, the user can observe the interior of the cooking chamber 30, for example, from the above and both sides of the microwave oven, as well as directly in front of the microwave oven. Accordingly, the user can ascertain the cooking status of food laid in the cooking chamber 20 while carrying out other tasks near the microwave oven.

A transparent panel (not shown) made of a transparent material is attached to an outside surface of the see-through member 32, so as to prevent the interior of the cooking chamber 20 from communicating with the exterior of the microwave oven, through the see-through holes formed on the see-through member 32, and enable the user to observe the interior of the cooking chamber 20 through the see-through member 32.

Although the see-through holes have been described as not being formed on the bottom plate 35 of the see-through member 32, in consideration of the fact that a microwave oven is generally placed at a position level with or below the eye-level of the user in a cooking space, the see-through holes may be formed on the bottom plate 35 so as to provide a further plane of view to view the interior of the cooking chamber 20.

As shown in FIGS. 2 and 3, the see-through member 32 of the door 30 is projected forward to form a half-cylindrical shape. Such a structure prevents the moisture generated from the food from condensing on the inside surface of the see-through member 32. This operation will be further described with reference to FIG. 4.

Figure 4:
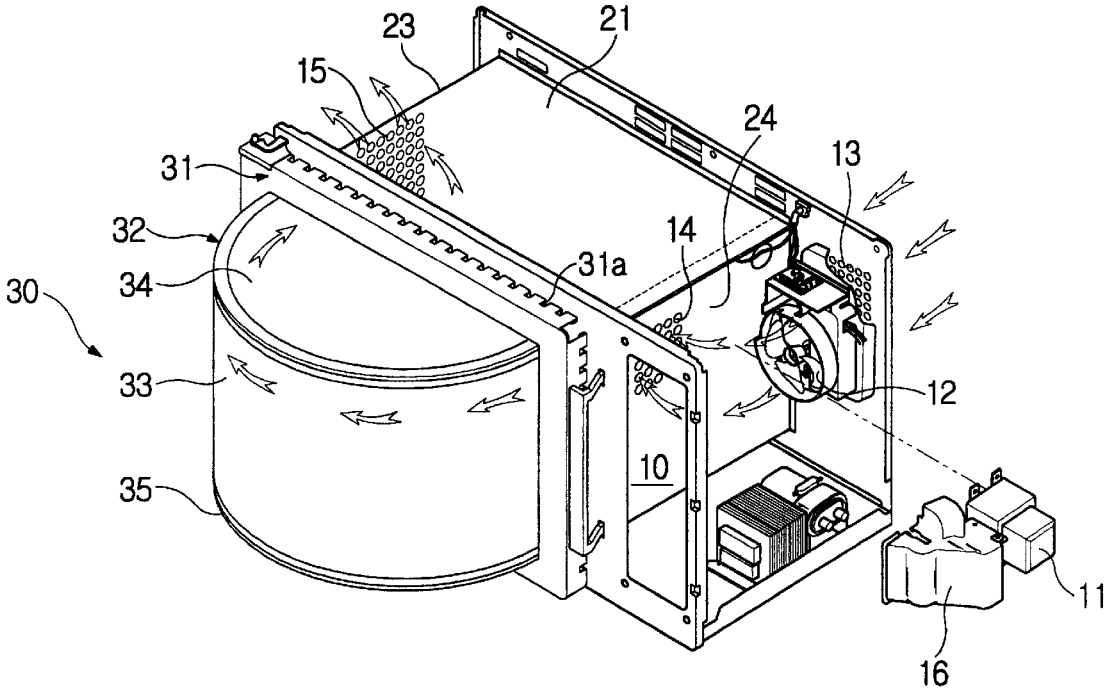
FIG. 4 is a perspective view of the microwave oven shown in FIG. 3 illustrating a flow of air which is fed into a machine room, passed through a cooking chamber, circulated through the cooking chamber and discharged from the cooking chamber to the exterior of the microwave oven.

FIG. 4 shows a perspective view of the microwave oven shown in FIGS. 2 and 3, illustrating a flow of air that is fed into the machine room 10, passed through the cooking chamber 20, circulated through the cooking chamber 20, and discharged from the cooking chamber 20 to the outside of the microwave oven.

As illustrated in the drawing, to suck outside air into the interior of the machine room 10, pass the air through the cooking chamber 20 and discharge the air from the cooking chamber 20 to the exterior of the microwave oven, a plurality of inlet holes 13 are formed on a rear wall of the machine room 10. Additionally, air feed holes 14 and air discharge holes 15 are formed on a right sidewall 24 and a left sidewall 23 of the microwave oven, respectively.

The blower fan 12 is positioned in front of the inlet holes 13, which are formed on the rear wall of the machine room 10, to suck the outside air into the interior of the machine room 10. The air feed holes 14 formed on the right sidewall 23 of the cooking chamber 20 are arranged near a front of the cooking chamber 20, so as to guide the air to the see-through member 32 of the door 30 and allow the air to smoothly flow along an arcuate inside surface of the see-through member 32. Additionally, the air discharge holes 15 formed on the left sidewall 24 of the cooking chamber 20 are arranged near the front of the cooking chamber 20 in the same manner as the air feed holes 14, so as to allow the air flown along the see-through member 32 to smoothly discharge from the cooking chamber 20 to the outside of the microwave oven. The magnetron 11 is disposed between the inlet holes 13 and the air feed holes 14. An air guide duct 16 is disposed between the magnetron 11 and the air feed holes 14 so as to guide the air having passed the magnetron 11 to the air feed holes 14 and feed the air to the interior of the cooking chamber 20.

By having an air circulation structure of the microwave oven described above, air fed into the cooking chamber 20 can smoothly flow along the arcuate inside surface of the see-through member 32, and the moisture generated from the food being cooked can be rapidly discharged through the air discharge holes 15, together with air flowing along the front and top plates 33 and 34 of the see-through member 32. Accordingly, the air circulating structure of the present invention effectively prevents the moisture from condensing on the arcuate inside surface of the see-through member 32. Consequently, the user can more clearly observe the food laid in the cooking chamber 20 through the see-through member 32.

As described above, the present invention provides a microwave oven having a front plate of a see-through member which is half-cylindrically projected forward, and top and bottom plates of the see-through member which cover corresponding top and bottom of an inner space formed inside the front plate of the see-through member. Accordingly, the interior of a cooking chamber can be observed from a variety of viewing locations or angles, enabling a user to rapidly ascertain a cooking status of the food from various locations outside of the microwave oven.

That is, the microwave oven of the present invention enables the user to ascertain the cooking status of the food from the various locations, and therefore, the user can observe the interior of the cooking chamber while carrying out other tasks near the microwave oven. As such, the present microwave oven is convenient to use as it is not necessary for the user to approach the microwave oven to ascertain the cooking status of the food.

Additionally, a door having the present see-through member has an arcuate shape, and air feed holes and air discharge holes are formed near the door. Accordingly, air fed into a cooking chamber smoothly flows along an inside surface of the see-through member. Therefore, condensation of moisture on the inside surface of the see-through member is effectively prevented, and the user can more clearly observe the interior of the cooking chamber through the see-through member.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven, comprising:

a heating unit to cook food;

a cooking chamber having an opening; and a door which selectively opens and closes the opening of the cooking chamber, and comprises:

a frame which is constructed to form an outer edge of the door and be brought into contact with a rim of the opening, and a see-through member which is adapted to correspond to the opening of the cooking chamber, wherein the see-through member is projected forward to form an inner space in front of the cooking chamber so as to provide a multiple plane of views into an interior of the cooking chamber; and air feed through holes and air discharge holes provided on corresponding sidewalls of the cooking chamber at respective positions adjacent to the door so as to have the air from the air feed through holes flow along an inside surface of the see-through member and prevent the moisture from condensing on the inside surface of the see-through member.

2. The microwave oven according to claim 1, wherein the see-through member comprises:

a front plate having a half-cylindrical shape projected away from the cooking chamber, and top and bottom plates having a semi-circular shape which cover a corresponding top and bottom of the inner space formed in front of the cooking chamber, wherein the front and top plates include a plurality of see-through holes which provide optical views into the interior of the cooking chamber therethrough.

3. The microwave oven according to claim 2, wherein the see-through holes are formed across an entire area of the see-through member so as to allow an effective visual view of the interior of the cooking chamber.

4. The microwave oven according to claim 2, wherein:

the heating unit includes a magnetron which generates microwaves to cook the food, and the frame includes a plurality of choke slits which prevent a leakage of the microwaves from the cooking chamber through the door, where the opening is closed by the door.

5. The microwave oven according to claim 2, wherein the frame is sized so as not to obstruct the cooking chamber and have the inner space of the see-through member form a cooking space together with the cooking chamber.

6. The microwave oven according to claim 2, wherein the frame and the top and bottom plates are integrally formed as a single structure and attached to the front plate of the see-through member.

7. The microwave oven according to claim 2, wherein the front and top plates provide the optical views into the interior of the cooking chamber from at least in front of, above, and both sides of the oven.

8. The microwave oven according to claim 1, further comprising a transparent panel attached to a front of the see-through member to prevent the interior of the cooking chamber from communicating with the outside of the oven, through the see-through holes.

9. The microwave oven according to claim 1, wherein the heating unit includes a magnetron which generates microwaves to cook the, food.

10. The microwave oven according to claim 1, wherein:

the air feed through and air discharge holes are provided to corresponding sidewalls of the cooking chamber at respective positions adjacent to sides of the see-through member, and the see-through member has a curved shape, so as have the air from the air feed through holes flow along an inside surface of the curved see-through member and prevent the moisture from condensing on the inside surface of the see-through member.

11. A cooking apparatus, comprising:

a casing which defines an outer appearance of the cooking apparatus;

a heating unit to cook food; and an air circulation structure for receiving the food therein and exhausting moisture and odor generated from the food, wherein the air circulation structure comprises:

a cooking chamber having an opening to receive the food, air feed through paths formed on a first sidewall of the cooking chamber to receive air into the cooking chamber, air discharge paths formed on a second side wall of the cooking chamber to discharge the air from the cooking chamber to the outside of the cooking apparatus, and a door which selectively opens and closes the opening and is non-planar shaped to allow the air from the air feed through paths to flow along an inside surface of the door so as to prevent moisture of the food from condensing on the inside surface of the door.

12. The cooking apparatus according to claim 11, wherein the door is adopted to correspond to the opening of the cooking chamber and a portion of the door is projected forward to form an inner space in front of the cooking chamber, so as to provide a multiple plane of views into the inner space and an interior of the cooking chamber.

13. The cooking apparatus according to claim 11, wherein the air feed through and air discharge paths are provided at respective positions adjacent to sides of the door so as to have the air from the air feed through paths easily flow along the inside surface of the door and exit through the air discharge paths.

14. The cooking apparatus according to claim 11, wherein the door comprises:

a frame which is constructed to from an outer edge of the door to contact and close the opening, and a see-through member which is curved and have a half-cylindrical shape projected away from the cooking chamber, so as to provide the multiple plane of views into the cooking chamber and allow the air from the air feed through paths to easily flow a long an inside surface of the see-through member.

15. The cooking apparatus according to claim 14, wherein the door further comprises top and bottom plates which have a semi-circular shape and cover a corresponding top and bottom of an inner space formed by the see-through member in front of the cooking chamber.

16. The cooking apparatus according to claim 15, wherein the top plate includes a see-through portion so as to provide an additional plane of view into the cooking chamber.

17. The cooking apparatus according to claim 16, wherein the cooking chamber which receives the food includes the inner space formed by the door.

18. The cooking apparatus according to claim 11, wherein the heating unit includes a magnetron which generates microwaves to cook the food.

* * * * *